United States Patent [19]

Hinderks

[11] 3,952,823

[45] Apr. 27, 1976

[54] VEHICLE GAS EXTRACTOR

[76] Inventor: Mitja Victor Hinderks, 15a Adamson Road, Hampstead, London N.W.3, England

[22] Filed: Mar. 25, 1974

[21] Appl. No.: 454,607

Related U.S. Application Data

[63] Continuation-in-part of Ser. No. 270,034, July 10, 1972, abandoned.

[30] Foreign Application Priority Data

Feb. 1, 1974 United Kingdom ..... 4731/74

[52] U.S. Cl. ..... 180/64 A; 180/1 FV; 181/43; 296/15

[51] Int. Cl.[2] ..... F01N 7/20

[58] Field of Search ..... 180/1 FV, 64 A, 7 J, 180/69.1, 84, 115; 296/15; 181/38, 43, 51, 61, 72

[56] References Cited

UNITED STATES PATENTS

| | | | |
|---|---|---|---|
| 857,084 | 6/1907 | Lull | 180/84 |
| 1,483,354 | 12/1924 | Kopper | 181/38 |
| 1,560,947 | 11/1925 | Skelton | 180/64 A |
| 1,856,005 | 4/1932 | Tomshow | 180/64 A |
| 1,867,802 | 7/1932 | Bogert | 180/64 A X |
| 2,242,494 | 5/1941 | Wolf | 296/15 |
| 2,270,115 | 1/1942 | Eliot | 181/51 |
| 3,618,998 | 11/1971 | Swauger | 296/15 |

FOREIGN PATENTS OR APPLICATIONS

| | | | |
|---|---|---|---|
| 252,546 | 6/1926 | United Kingdom | 181/43 |
| 653,840 | 11/1937 | Germany | 180/64 A |
| 290,089 | 2/1916 | Germany | 181/49 |

*Primary Examiner*—Robert R. Song
*Assistant Examiner*—Terrance L. Siemens
*Attorney, Agent, or Firm*—Wigman & Cohen

[57] ABSTRACT

This invention relates in the main to the extraction of gases from moving vehicles, by means of a chamber having long narrow discharge aperture, and being mounted in the air-flow past the vehicle. Features of the invention include the provision of aerofoils to direct or control air-flow past the discharge aperture, and the provision of holes in the chamber which may admit some air-flow to the interior of the chamber additional to gases already passing through it. A further feature is the positioning of chamber and/or aerofoils so as to cause a downward thrust to be imposed on the vehicle. The chamber may process or extract gases coming from a passenger/driver compartment, from a high pressure area beneath the vehicle to improve road-holding, and from the exhaust ports of an engine. An apparatus is provided within the chamber for the acoustic treatment of gases and such apparatus may be adapted to configurations suited to the invention.

17 Claims, 54 Drawing Figures

FIG. 1.
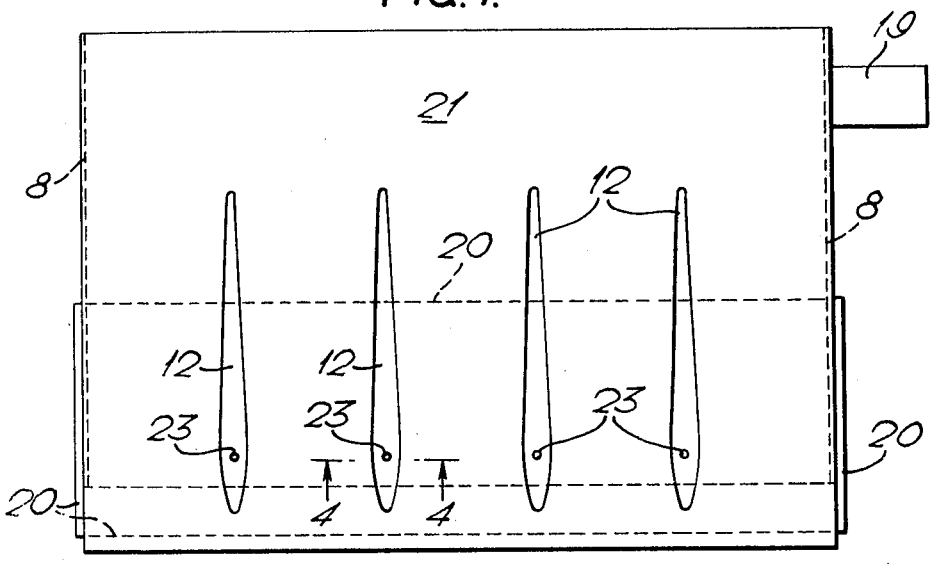
FIG. 2.
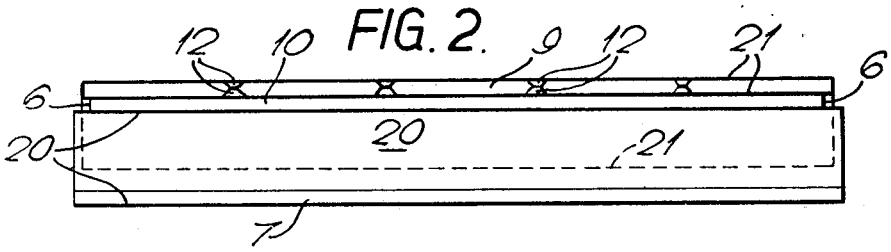
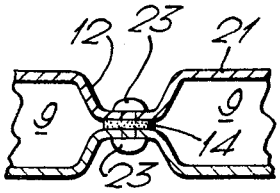
FIG. 4.
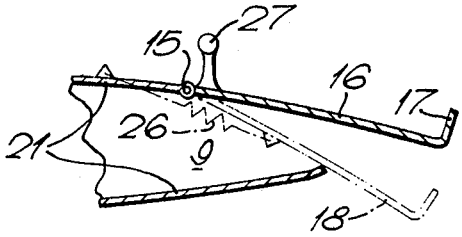
FIG. 5.
FIG. 3.
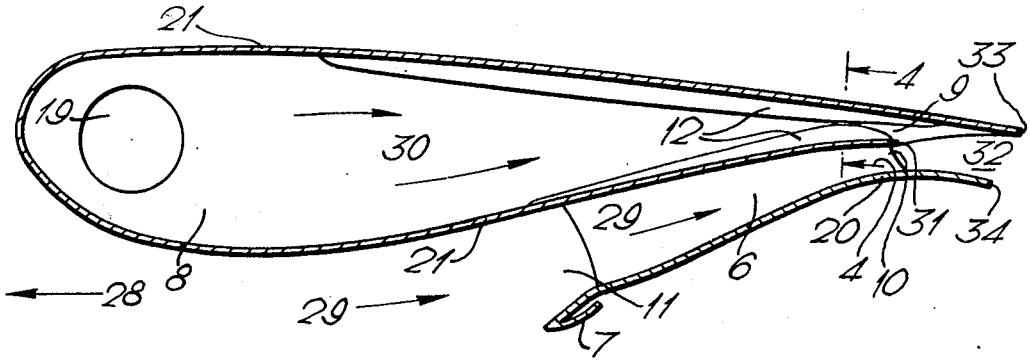

FIG 6
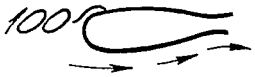
FIG. 7.
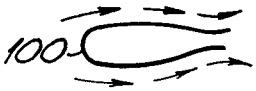
FIG. 8.
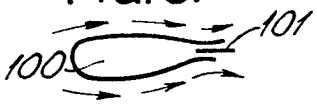
FIG. 9.
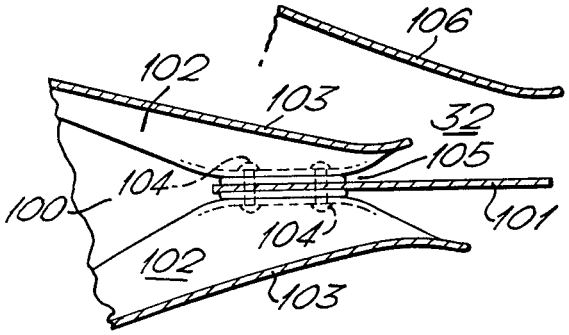
FIG. 10.
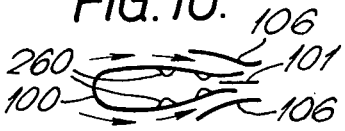
FIG. 11.
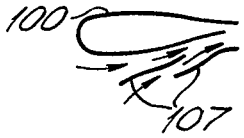
FIG. 12.
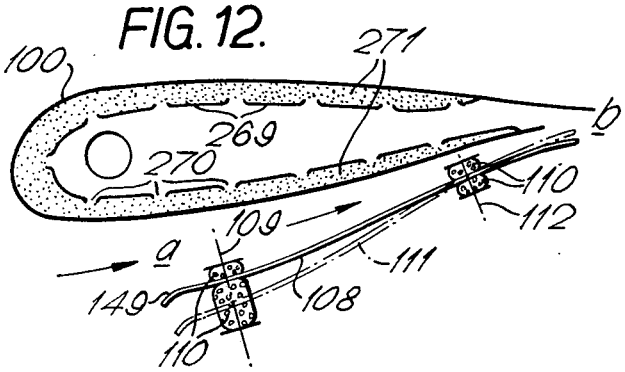
FIG. 13.
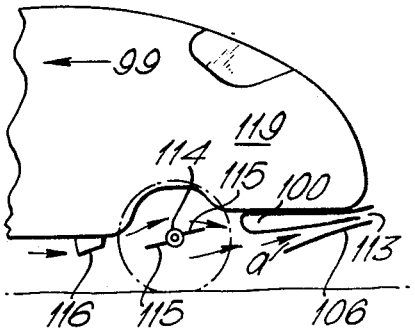
FIG. 14.
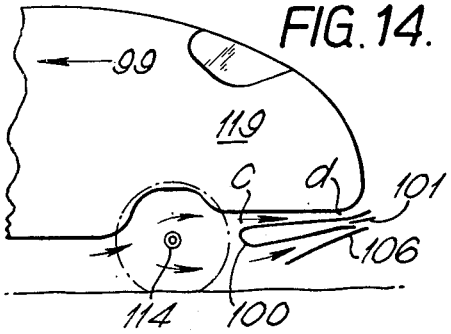
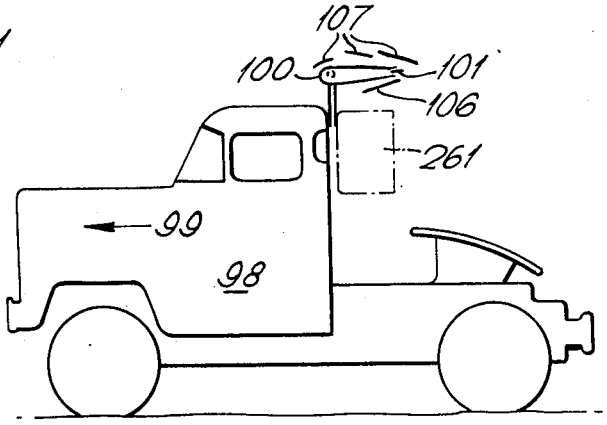
FIG. 15.

VEHICLE GAS EXTRACTOR

CROSS-REFERENCE TO RELATED APPLICATION

This application is a continuation-in-part from application Ser. No. 270,034, filed July 10, 1972, now abandoned. The present invention relates to exhaust gas silencers or mufflers and gas extraction means for land surface vehicles, as well as stationary or semi-mobile internal combustion engine power plants, such as air compressor units, electricity generators, etc. The inventive steps constituting the improvements to the silencer and its relationship to the vehicle are not in the main in the traditional sphere of noise reduction, but relate to five other aspects, set out below, some or all of which pertain to the applications previously described.

a. The silencer arrangement is intended to contribute, to a greater extend than existing systems, to a reduction of the load imposed on the engine in pumping gases through its exhaust system, and is especially intended to help offset the considerable power losses caused by the loads imposed by the exhaust gas purifying means now legally required in many industrial countries. To achieve this, the old concept of harnessing the airflow past a moving vehicle is used, but in a greatly more logical and efficient way than the rather ineffective systems currently available. Together with this feature (only relating to regularly mobile vehicles) there is at the exhaust system exit an improved gas distribution and possible significant reduction in gas velocity, all these factors affording the opportunity, with proper detail design, of achieving fuel economies and/or power increases. It is well known that following the international and fuel crises of late 1973, fuel economies and engine efficiency have assumed prime importance.

b. The silencer is intended to be so arranged and constructed as to completely eliminate the risk of accidental burning to persons about the nearly stationary vehicle or power unit, currently considered a danger especially where exhaust emission treated engines are coupled to a conventional exhaust system. It is known that such emission treatment involves extra oxidation-producing heat, taking place in heavily insulated chambers - preventing normal heat loss. The very much hotter (compared with untreated engines) gases issuing from a conventional tailpipe could conceivably strike a standing individual in a localised spot, for example, the leg, in such a way that the thermal load directed on such a restricted area will cause burning. The situation described above may be envisaged, for instance, in downtown choked traffic conditions with heavy, slow moving pedestrian activity about and behind nearly stationary vehicles. The invention, because its gas exit is through a long narrow aperture rather than a pipe of concentrated area, causes the gases to be widely distributed in such a way that only a fraction of the gases, and therefore only a fraction of the thermal load put out by a power plant, could strike an individual normally.

c. It is considered that the invention will contribute to an improved appearance of the vehicle or unit to which it is fitted, especially in the case of passenger cars. At the moment, these often have an appearance, viewed from the rear, which is smoothly styled above rear bumper level and a rough arrangement of silencer chamber, straps, clamps, stub tail pipes, etc., below it. This difference is particularly striking at night, where such a vehicle is viewed from the rear under strong headlight illumination. It will be evident that the invention is capable of being so realised as to present a rear view consisting of a single, regularly shaped unit.

d. The silencer assembly may be so designed that it fulfils one or more secondary functions, additional to the treatment or accommodation of exhaust gas. It may partly act as a passenger and/or engine compartment air extractor. Equally the physical construction constituting the invention may be used only to fulfil the latter function(s).

e. Under some conditions, when the silencer is mounted in a certain way and/or when certain components are used in association with it, then the assembly may act as an aerofoil, the airflow causing a downward thrust to be transmitted to the assembly and therefore to the vehicle to which it is fixed, thereby causing improved road adhesion and incidentally a progressive stiffening and lowering of the suspension with increase in speed. The various possible ways this effect can be achieved are shown in the accompanying diagrams and description.

The invention comprises a surface vehicle having mounted upon its underside at least one chamber to receive and distribute gases associated with the vehicle, said chamber having elongate gas discharge means spaced from gas entry means and having at least one major surface defining the discharge aperture(s) the chamber mounted so that the aforementioned surface(s) are disposed in the air-flow beneath the vehicle when in motion in such a manner as to enable part of said air-flow to pass along the surface(s) and subsequently past the discharge aperture(s) so as to assist in the dispersal of gases from the chamber.

The invention further comprises a surface vehicle having mounted above or to the side at least one chamber to receive and distribute gases associated with it, said chamber having elongate gas discharge means of substantially slit-like configuration spaced from gas entry means and having at least one major surface defining the discharge aperture(s) the chamber mounted so that the aforementioned surface(s) are disposed in the air-flow about the vehicle when in motion in such a manner as to enable part of said air-flow to pass along the surface(s) and subsequently past the discharge aperture(s) so as to assist in the dispersal of gases from the chamber.

The invention further comprises a chamber to receive and distribute gases associated with a vehicle or engine, said chamber having elongate gas discharge means spaced from gas entry means, said chamber adapted to be mounted on a vehicle so as to be placed in the airflow past the vehicle when in motion and having about those surfaces exposed to the air-flow means defining apertures for the admission of part of the aforementioned air-flow through the chamber, additional to other gas flow and to the first mentioned gas entry means.

The invention further comprises a chamber to receive and distribute gases associated with a vehicle or engine, said chamber having elongate gas discharge means spaced from gas entry means, said chamber in cross-section having a substantially 'C' shaped configuration.

The invention further comprises a chamber to receive and distribute gases associated with a vehicle or engine, said chamber having elongate discharge means spaced from gas entry means, said chamber in cross-sectional configuration comprising a main substantially arcuate body portion having an extension forming a discharge passage, only one means defining said passage describing a substantially continuous and tangental surface springing from the main body portion, said cross-sectional configuration being hereinafter for convenience referred to as "comma-shaped".

The invention further comprises a chamber to receive and distribute gases associated with a vehicle or engine, said chamber having elongate gas discharge means spaced from gas entry means, said chamber in cross-section being of substantially 'U' shaped configuration, having mounted in association with it at least one aerofoil member, to assist in the provision of air-flow past the discharge aperture.

The invention further comprises a chamber to receive and distribute gases associated with a vehicle or engine, said chamber having elongate gas discharge means spaced from gas entry means, said chamber of substantially rectilinear configuration in plan form, having mounted within it gas treatment means in the path of the gas flow.

The invention further comprises a chamber to receive and distribute gases associated with a vehicle or engine, said chamber having a long narrow gas discharge aperture of substantially slit-like configuration spaced from a gas entry means, said chamber is cross-section of substantially 'U' shaped configuration, having dividing member(s) running lengthwise in the elongate discharge means causing the gas flow to be separated into at least upper and lower portions.

The embodiments of the invention may be combined in any suitable way and incorporated in one assembly. For example, the comma-shaped chamber may be provided with holes admitting air-flow to the tail portion of the chamber, and may have within its main volume exhaust emission treatment means disposed in the path of the gas flow. In the accompanying drawings:

FIG. 1 is a plan view of an exhaust gas silencer, an embodiment according to the present invention;

FIG. 2 is a rear view of the exhaust gas silencer shown in FIG. 1;

FIG. 3 is a typical cross-section through the silencer shown in FIG. 1 wherein the direction of vehicle travel is from right to left;

FIG. 4 is a detail section showing the attachment of the upper and lower walls of the chamber at the rear;

FIG. 5 shows an alternative construction for amphibious vehicles or vehicles which need to at least partly close the exhaust system.

FIGS. 6 to 15 illustrate by way of example various possible airflows about embodiments of the invention and ways in which these embodiments may be mounted on a vehicle;

Figure 16:
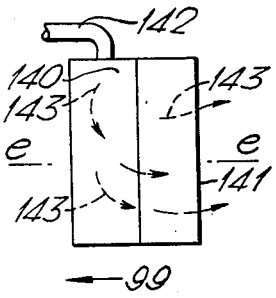
FIG. 16 shows a plan view of a further embodiment, including a so called comma-shaped chamber.

FIGS. 45 to 50 show by example various constructions and fixings of aerofoil means; and FIGS. 51 to 54 show, by way of example, alternative forms of discontinuous elongate discharge means. The embodiment of FIGS. 1 to 4 comprises, by way of example, a metal sheet 21 bent to a substantially U-shaped configuration about two flat side pieces 8 to which is brazed, welded, glued or clamped, one side piece having an exhaust gas inlet stub pipe 19. The bent sheet has U shaped stiffening recesses 12 pressed into the upper and lower surfaces, which are coincident with and attached to each other by rivets 23 near the exhaust gas discharge end 9 as shown in FIG. 4, the said surfaces being separated by an asbestos washer 14 to reduce vibration and resonance. Optionally, beneath the chamber and attached to it by metal flanges 6 is a curved metal aerofoil 20 which has a leading edge stiffening lip 7.

In the alternative arrangement shown in FIG. 5 a metal flap 16 having a stiffening flange 17, is pivotally attached to the upper surface of sheet 21 by a hinge 15 allowing the flap to pivot towards a closed position, the operation being actuated either manually or automatically or by gravity acting against pressure below a certain level. Optionally, for instance where a certain amount of back pressure is desired at low engine speed only, or where the system is designed to nearly close at low engine speeds in cross-country vehicles when fording streams, the closure member 16 may be arranged, for example by means of a spring 26 or counterweight system 27, to be either in the properly open position without tending to exert any load on the gases or to tend towards the closed position, exerting some back pressure. The movement changing the weight or spring action from positive to negative could, for example, be linked by cable to either a manual control or a manifold vacuum actuated piston, or to a combination of both of these and/or other factors. The chamber may have within it gas treatment means such as exhaust gas purification or silencing means and/or means for controlling the flow of gases, such as baffles. Various arrangements for gas treatment will be described later in this disclosure.

In operation, considering by example the embodiment of FIGS. 1 to 4, the chamber and vehicle to which it is attached when moving in the direction 28 cause an airflow to pass along at least one major surface of the chamber in the direction 29, providing that the chamber has been fitted to the vehicle in the intended and proper manner, which is more fully described later. This air-flow past the lower lip 31 of the chamber will cause a pressure reduction across the length of the aperture, thus creating a 'suction' type effect on the exhaust gases. The optional aerofoil 20, placed in the path of the airflow 29 about the vehicle, when positioned in relation to the chamber so that the air entry area 11 is greater than the air discharge area 10, and also properly placed in relation to the direction of airflow, will cause a further increase in the speed of air moving past the exhaust discharge end 9, thereby further enhancing the pressure reduction effect described above. As can be seen in FIG. 3, extremities 33 and 34 of the chamber 21 and aerofoil 20 respectively are arranged to project past the lower lip 31 of the discharge end to create a volume 32 where the (accelerated) air moving past the vehicle is allowed to mix with the exhaust gases in a controlled space. The air rushing past has a considerable mass and when intermingling with the exhaust gas will exert a ram effect on the latter assisting their expulsion from the chamber and additionally contributing to the pressure reduction effect near the discharge aperture. These suction or ram or venturi effects are known, and in part have been applied to tail pipes with modest effect. However, the discharge aperture of the invention is in the form of a long slit, which means that these effects will be many times more efficient than when applied to a tail pipe, since in the case of the latter only a very narrow band of the slowest moving circumference of the gas column is affected, leaving the faster moving core relatively untouched, whilst the benefits of the invention consist partly of applying these effects to much greater degree to every possible portion of the exhaust gas. Furthermore, the presence of a long slit allows for the provision if desired of a gas exit area many times greater than that of a tail-pipe, resulting in an inversely proportionate reduction in gas velocity, compared both to a conventional system and likely gas speeds upstream of the invention. This in itself will result in a power saving, but it also means that the speed differential between the exiting gas, moving relatively slowly, and the possibly accelerated air-flow past the discharge end 9 to be so much greater, thereby causing the air-flow to so much more efficiently assist, by means of suction and ramming, the expulsion of the exhaust gases.

The U-shaped silencer described above may be attached to a vehicle in a number of ways, which are here illustrated in diagrammatic form. The principles of fixing and the relationships of silencer to vehicle which are here outlined, are intended to apply equally to the 'C' shaped silencer chamber and the comma-shaped chamber, although in the case of the latter it is suitable for use in situations where there is to be an air-flow past only one major surface of the chamber. In FIGS. 6–15 the unnumbered arrows always indicate the direction of air-flow past the chamber 100 and the arrow 99 the direction of vehicle/chamber forward travel. The principles of the invention may be incorporated in chambers of triangular or other form, but for reasons of simplicity only the more practical embodiments are described and illustrated.

In FIG. 6 a chamber 100 is shown diagrammatically in cross-section having an air-flow past only one major surface while FIG. 7 shows a similar chamber having an air-flow past two major surfaces. In the case of the latter configuration, the slit-like discharge aperture may be optionally longitudinally split by a divider member 101, as shown in FIG. 8, this divider being intended to prevent the suction/ram effect about one discharge lip to affect detrimentally that about the other, as might happen especially if the two airflows were of significantly varying volume or speed. This divider member, if used in association with aerofoils also allows for the provision of two separate mixing areas 32. FIG. 9 shows by way of example an enlargement of a part cross-section of the discharge end of the chamber of FIG. 8, where the divider 101 consists of a metal plate clamped between the pressed depressions 102 in the walls 103 of the chamber, by means of fasteners such as rivets 104 and fibrous compressible spacer washers 105, e.g., of asbestos, which may be continuous between the two in-line fastenings; although each air-flow may have an aerofoil assembly associated with it, here one side is shown without and the other with an aerofoil 106.

FIG. 9 shows a chamber, shown diagrammatically in cross-section, having a single aerofoil 106 associated with the air-flow past one surface, whilst FIG. 10 shows a chamber with discharge aperture divider having air-flows past two major surfaces and aerofoil members associated with each flow, the chamber having internal restriction means 260, the purpose of which will be described later. FIG. 11 shows multiple aerofoils 107 acting on an air-flow past one surface of a chamber. FIG. 12 shows an aerofoil 108 having a movable pitch, variable according to the speed at which the vehicle is travelling. It is fixed, at points notionally indicated by lines 109, 112 by means of washers 110 of varying compressibility and size. At moderate speed the flow of air is not substantial enough to deflect the aerofoil 108 from the position shown against the washers, whilst at great speed the air-flow is so strong as to push the aerofoil to the position indicated by line 111 and overcome the resistance of the washers. Such a progressive change of pitch with increase of speed will increase the acceleration factor of the air moving between aerofoil and chamber, since the inlet gap at *a* has become larger and the outlet gap (in the embodiment shown) at *b* smaller. The proportion of the increase of the first in relation to the decrease (if any) of the second can be controlled by the positioning of the attachment at 112, which has a pivotal effect. The suspension of the aerofoil may also be by any other means of springing, including coil springs, spring steel elbow arms, etc., with relatively light suspension and fairly long travel, plus the turned down stiffened aerofoil leading edge 149 shown, the assembly can be designed to give little air-flow acceleration and high ground clearance at lower speeds, as would be used travelling over rough ground, and provide greater air-flow acceleration with a reduction in ground clearance at fast highway speeds. These aerofoil arrangements can be applied to any combination (see also FIG. 15) of any of the basic air-flow/discharge aperture configurations illustrated in FIGS. 6 – 9.

The various silencer assemblies may be fixed to vehicles in a number of preferred embodiments. In the case of passenger cars and most light goods vehicles the chamber is best fixed on the rearmost underside of the vehicle, with the discharge slit running transversely across the rear, parallel to the ground and projecting clear of the bodywork, with at least one major surface of the chamber properly exposed to the air-flow passing underneath the vehicle. FIG. 13 shows a passenger saloon car 119, normal direction of travel 99, shown diagrammatically in cross-section with the chamber 100 and aerofoil 106 fixed transversely across the rear underside of the vehicle, with the slit discharge aperture 113 projecting past the rear bodywork, with the assembly running substantially across the full width of the vehicle after allowance for wheel arches, etc., substantially as shown in the example illustrated in FIG. 25. The assembly is so positioned as to make the fullest use of the air-flow under the vehicle; both chamber and optional aerofoil attachment are at least partly in the air-flow so as to cause a partial deflection of said air-flow which, in the arrangements shown, will cause the air-flow in deflection to adhere under some additional pressure to and flow smoothly past the intended surfaces of the assembly, especially the major surfaces of the chamber. In FIG. 13 are shown alternative optional independent means of assisting the air-flow past the desired surfaces of a silencer assembly, the embodiments showing diagrammatically a scoop 116 fixed to the underside of the vehicle ahead of the invention and, (not necessarily used together on the same vehicle) vanes or stub aerofoils 115 attached to a rear axle or suspension member 114. Both underbody scoops and axle aerofoils serve both as a means of directing extra or improved air-flow to the silencer/extractor and also possibly as aerofoils acting to exert a deliberate downward load on the vehicle or suspension member. This will result in improved road holding generally and also, when fitted to a suspension member, will tend to reduce wheel hop, flutter or tramp. FIG. 14 similarly shows the rear of a vehicle 119 with a similar chamber 100 and aerofoil 106 but here so placed that there is a second air-flow between chamber 100 and vehicle 119, the chamber, by way of example, having an optional divider 101. In the embodiment illustrated, the second or upper air-flow is also subjected to an acceleration effect due to the positioning of the chamber in relation to the vehicle, this being such that the gap at *c* is larger than the gap at *d*.

Figure 17:
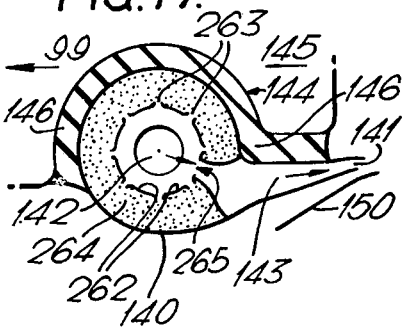
FIGS. 17 & 18 show alternative cross sections through line 'e' in FIG. 16.

FIG. 15 shows diagrammatically, by way of example, the front portion or tractor unit of a commmercial vehicle 98, normal travel direction 99, having mounted in the region above the cab a silencer/extractor chamber 100 according to the present invention, having a single aerofoil 106 in association with the air-flow past the lower major surface of the chamber and multiple aerofoils 107 in association with the upper major surface. For simplicity, fixings, exhaust pipes and chamber gas entry points have not been shown. In an alternative arrangement, the chamber assembly may be mounted to the side of the vehicle, as shown in dotted outline 261. The chamber may be in the shape of alternative forms, including that of a comma or a C. The comma configuration is particularly suitable where only one major surface is intended to be exposed to the air-flow and where the chamber is fixed to a section of the underside of a vehicle having box-type sections. FIG. 16 shows in plan view an embodiment of such a chamber 140 where 99 is the direction of normal travel, 141 the slit discharge, 142 the gas entry point and 143 the direction of gas travel through the chamber. FIG. 17 shows a cross-section along line *e* with part of the main body of the chamber 140 recessed into a box-like stiffening depression 144 in the underside of the vehicle 145 and spaced from it by a suitable (compressible) mounting, insulating or sound and vibration dampening material 146, such as asbestos or glass fibre, high temperature aerated rubber, etc. An optional aerofoil 150 is provided. Within this chamber is provided another substantially concentrically positioned chamber 262 having punched holes 263 and separated from the outer chamber by acoustical treatment means 264, the inner chamber having access to the gas entry means 142 and having its own long narrow discharge aperture 265, where 143 shows direction of gas flow.

Figure 18:
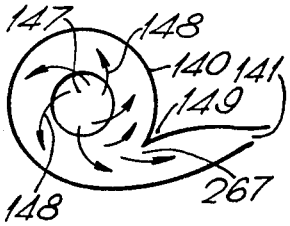
Figure 19:
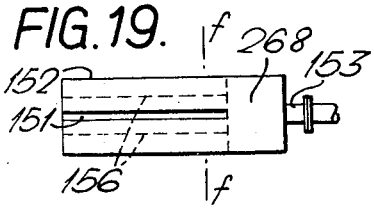
FIG. 19 shows an elevation, viewing the slit aperture, of a cylindrical or C-shaped chamber, a further embodiment of the invention.
Figure 20:
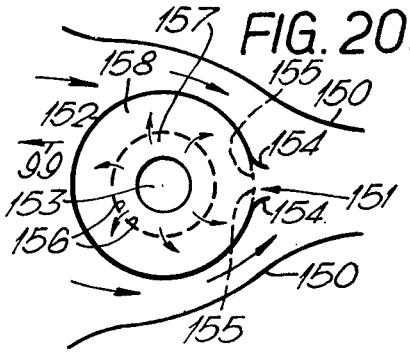
FIG. 20 shows a cross section through the above chamber.

FIG. 18 shows in similar cross-section an alternative arrangement suitable where the gases enter the chamber through a central side entry 147 with a degree of rotation or swirl 148, here shown anti-clockwise. The sharp edge at 149 serves as a natural divider not impeding or disturbing the gases continuing to swirl while allowing some gases to be extracted through 141. The chamber may also be C shaped, as shown diagrammatically in elevation viewed from the rear in FIG. 19, where the long slit-like gas discharge aperture 151 runs substantially the full length of and interrupts a cylindrical casing 152 having a substantially concentric gas entry point 153 at one end. FIG. 20 shows a cross-section along line *f* with the discharge aperture being defined by curved lips 154. Alternatively the lips may be an extension of the cylindrical form, as shown dotted at 155. Optional aerofoils 150 are also shown. Such a chamber 152 may have within it a permeable concentric barrier 156 or barriers, serving as filtration, cleansing and/or silencing means, dividing it into two or more concentric volumes, the gas entering and filling the innermost volume 157 and having to pass through the barrier 156 to the outermost volume 158 communicating with the discharge aperture 151.

The embodiment of the invention in C or comma shaped chambers has certain advantages. In C shaped form, some degree of control of extraction effect may be sacrificed, although the force of this effect is not necessarily compromised. The relatively greater bulk of the chamber will cause a stronger turbulence of greater variation according to air-flow speed — hence some loss of control over the whole spectrum running conditions — but will also cause a relatively stronger lower pressure area to be formed behind the discharge aperture. The C shaped construction also allows gas treatment means of annular or circular configuration to be disposed within the chamber, allowing the gases if desired to pass, e.g., from an inner volume to an outer volume through a pierced chamber, or alternatively passing gases through a pierced inner chamber having, e.g., sound absorbent materials between it and the outer chamber. Such treatment means can be applied to any embodiment of the invention, but here they may be circular, oval or cylindrical. Existing production means, components, manufacturing techniques can be applied to carry the invention into effect in its C shaped configuration, a very important point when considering the feasibility of properly introducing an innovation of possible social benefit. Any saving in capital expenditure is a saving of resources and, in the view of some persons, a desirable objective. The comma-shaped chamber represents a valuable compromise between the C and U shapes. In the body of the comma may be disposed gas treatment means of traditional construction and configuration, whilst the provision of a substantially partly tangential tail allows a major surface to be exposed to an air-flow. This construction is particularly suitable for fixing to the underside of vehicles where the body of the comma may fit into say a strengthening depression in the vehicle and is also a form which facilitates acoustical treatment of the gas, since the comma clearly consists of two separate volumes. The provisions of a narrowing or neck as at 267, FIG. 18, will enhance the distinction between the volumes. The division of a chamber into separate but inter-connected volumes is a known principle of acoustical treatment. The invention only indirectly relates to acoustical treatments, since its objects lie in other fields. However, it may partly be used for such purpose, so hereafter will be described briefly any acoustical advantages of the invention and ways in which known techniques of acoustical treatment may be applied to it.

The acoustical advantages of the invention are twofold. Firstly, the gases and sound issue from the discharge aperture in a direction which will in most embodiments be likely to be substantially at right angles to the direction of gas flow into the chamber, thus reducing the transmission of any sound which may have been "trumpetted" into the chamber by a circular gas entry pipe. Secondly, and especially in the embodiments just described, the direction of gas flow from and through the discharge aperture, which can be expected to describe a complex three dimensional curve, will not substantially correspond to the planes and surfaces of chamber walls, which in themselves may not be regular but, as in the U shaped configuration, may describe the form of a progressively varying curve. This absence of both the "parallelism" and the straight-line gas flows of traditional construction will contribute to a reduction of resonance and also of multiple reflections between chamber walls.

Figure 29:
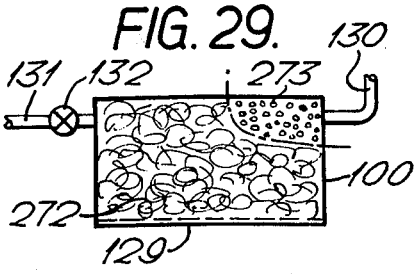
FIG. 29 shows an embodiment of the invention, intended to meet safety and legal requirements in certain applications.
Figure 35:
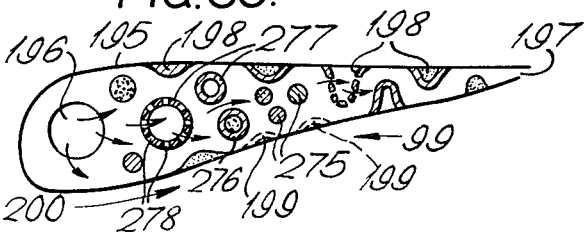
FIGS. 35 to 39 show how alternative configurations of gas treatment means may be incorporated in, by way of example, a chamber of substantially U-shaped configuration.
Figure 38:
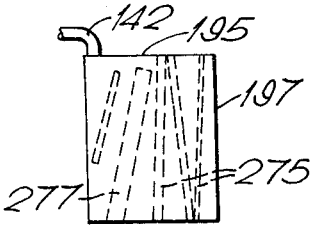
Figure 39:
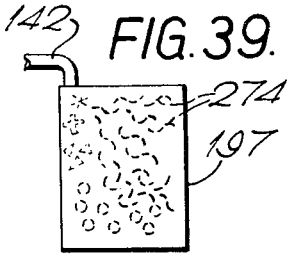
Figure 40:
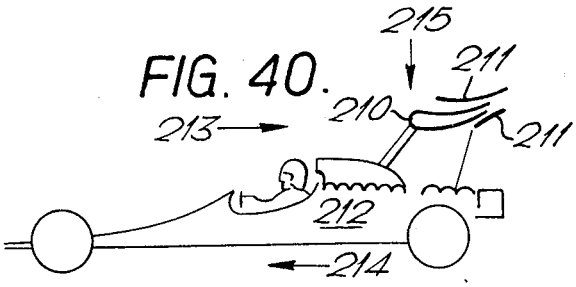
FIG. 40 shows an embodiment of the invention adapted to be mounted on a racing or competition vehicle, the whole shown in diagrammatic side elevation.

The disclosures and previous descriptions of cross-sections FIGS. 17, 18 and 20 have already shown by way of example ways in which traditional sound muffling techniques may be incorporated in the invention, where the gas flows are indicated by 143 and 148, gas entry points in elevation by 142, 147 and 153, etc. The cross-sections shown may only be that of part of the chamber; there may for example be an expansion box formed according to known principles in the chamber adjacent the gas entry point, as shown at 268 in FIG. 19. The various acoustical treatment means, including those shown, may be applied to the invention in any of its forms, including where the chamber is U-shaped. FIG. 12 shows for example a chamber 100 of U-shaped cross-section having within it a similar chamber 269, preferably pierced as at 270, with glass wool or the like disposed between the chambers accoustical absorption material 271. As has been mentioned above, a known technique is to divide a chamber by partial restricting means 260 into distinguishable smaller volumes as shown in FIG. 10. Disposed within the chamber may be filamentary material as shown in FIG. 29, through and about which the gases pass. This material may be in the form of wool 272, such as of glass or ceramic fibre, or alternatively of some form of inverted honeycomb construction, consisting of, e.g., ceramic rods 273. Such filimentary material may be used both for acoustical reasons and to assist in the de-toxification of gases. The chamber, especially if of U-shaped configuration may have spanning between its major surfaces a succession of short sheets or baffles 266 (FIG. 24), preferably placed at non-parallel angles to each other to reduce inter-reflection between their surfaces, and in such a manner that they do not directly obstruct gas flow but preferably distribute and direct it through the chamber. In a further embodiment the vertical sheets or baffles may be of curved or S-shaped configuration as at 274 in FIG. 39. This would enhance contact between gases and baffles, desirable if the baffles are to be so constructed as to be used as sound absorption or as exhaust emission control means. In such a case the baffles may be of porous ceramic or compacted glass or ceramic fibre material. The U-shaped configuration lends itself to the provision within the chamber of treatment means consisting of a succession of long members disposed substantially parallel to the gas discharge aperture, as shown by way of example in FIG. 35, a cross-section through a chamber 195, where in a series of rods 275, tubes 276 or cylinders 277 of unequal diameter are disposed at say marginally varying angles substantially parallel to the discharge aperture 197, as shown diagrammatically in plan view in FIG. 38. Gas enters the chamber 195 by means of a gas entry point 196 and flows substantially over the tube or rod-like structures, rather than parallel or inside them as is known. The structures may have holes 278 to admit gas transversely through them.

Figure 36:
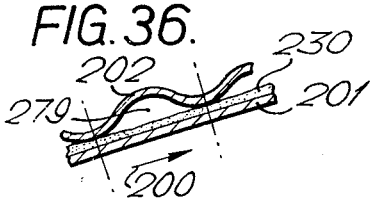
Figure 37:
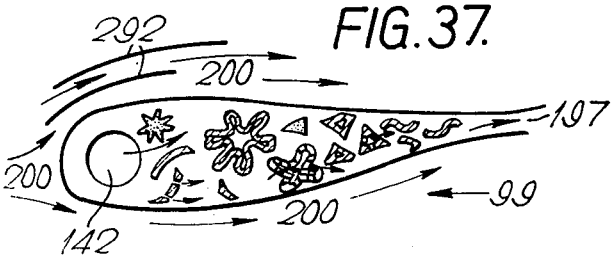

To prevent the gas taking the line of least resistance along the surface of the chamber, portions 198 of the rod or tube-like structures may be fitted against the interior surfaces as shown. Alternatively the wall of the chamber may be formed in a multiple curved shape, as indicated in dotted outline at 199. If there is an exterior air-flow 200 past a surface, then the chamber may be of double walled construction as shown in part detail in FIG. 36, where by example the flat exterior skin 201 is separated from the multiple curved or waved inner skin 202 by an optional interlayer 230 of sound absorbing and/or insulating material. This material plus the trapped air 279 would be useful insulation where a silencer, perhaps treating gases for emissions, is mounted to the underside of a vehicle. The long treatment members need not be of circular configuration and FIG. 37 shows alternative cross-sectional shapes. It may be argued that the provision of such treatment means, fulfilling amongst other possible functions the object of sound reduction, will be self defeating since they impose a load on the gases passing past them which counter-balances possible flow gains derived from the extraction effect at the discharge aperture. Unfortunately the gas treatment means are usually a necessity demanded by social and legal requirements and have to be incorporated in any system. When fitted to the invention a lower power loss is obtained than when using a conventional system; it can be argued that the extraction effect offsets or regains some of the losses caused by required gas treatment means.

Figure 21:
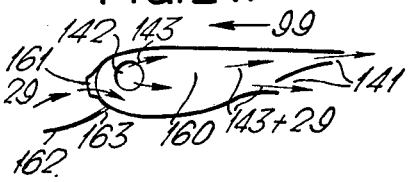
FIGS. 21 to 24 show alternative arrangements of an additional embodiment, namely means of air-flow entry into a chamber.
Figure 22:
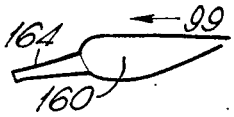
Figure 23:
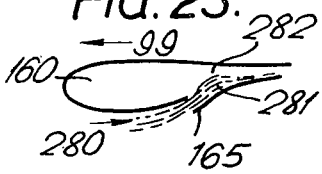
Figure 24:
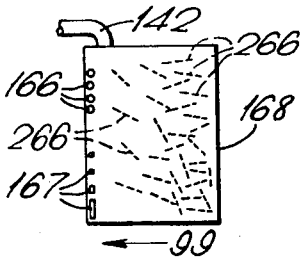

Means defining apertures may be provided about the surfaces of the chamber where these are exposed to the air-flow past a vehicle in such a manner as to admit, at least under some conditions of vehicle movement, some of the air-flow into the chamber interior. Under highway cruising conditions for example, this admission of air-flow into the chamber would have a ram effect and with proper design could be made to assist in the expulsion of exhaust gases from the chamber providing the discharge aperture is of suitable size to cope with the additional gas flow. FIG. 21 shows a chamber 160 having slightly lipped holes 161 and provided with an optional scoop or air dam 162, which may have small holes 163 near its junction with the chamber to act as moisture weep holes. FIG. 22 shows a chamber 160 having long snout like air entry means 164, similar to those fitted to certain types of carburettor air cleaners. FIG. 23 shows a chamber having punched scoops 165 as air intake means, with 280 indicating air-flow past and through the chamber. FIG. 24 shows diagrammatically in plan view a chamber 160 having by way of example alternatively a series of circular holes 166, or alternatively oblong slit-like holes 167 about its leading edge, with internally displaced baffles 266. The holes may progressively vary in size and/or spacing, as shown by way of example at 167, to provide ram effect of intensity varying according to distance from the gas entry point 142, to ensure an evenly distributed extraction effect at the discharge end 168.

The provision of holes in the chamber to admit part of the air-flow past the vehicle has many possible benefits. The obvious one is that the air will act as a ram, pushing the gases out of the chamber as distinct to extracting it as it passes discharge aperture lip. Further, by selective positioning of holes in certain places the air-flow can be made to steer the gases along intended paths from entry to exit through the chamber, especially where the entry flow is substantially at right angles to exit flow. Further, by positioning holes similarly to that as shown in FIG. 23, the entering air-flow 280 will create a physical barrier 281 when in the chamber, with a consequent part-restriction at 282. As is known, such restrictions dividing a volume into sections can significantly contribute to sound reduction. Last but not least, the provision of air-flow through the chamber can contribute to cooling. Gas treatment generally involves heat build up, in the case of exhaust emissions due to oxidation and in the case of sound reduction due to the fact that sound waves, when passing through sound-deadening material, are converted by means of friction to heat.

Figure 54:
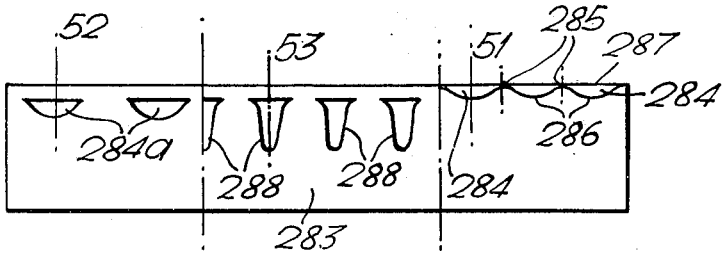

The gas discharge aperture has been described as long and narrow, of slit-like configuration, and has been shown to be continuous. However, in an alternative embodiment it need not be continuous but consist of a series of apertures which together have a long narrow configuration viewed from the rear, and which shall be called elongate discharge means, and is the aperture assembly referred to in the statements of invention. FIG. 54 shows diagrammatically in elevation the rear view of a chamber 283 having, by way of example, alternative arrangements of the aperture assembly, with FIGS. 51 to 53 part cross-sectional views of the alternatives, where 284 are punched and pressed to a circular segment configuration. Apertures 284 are defined by the fastening at 285 of a "waved" lower chamber surface 286 to a straight upper surface 287 and where apertures 288 are of substantially sharp pyramidal configuration.

Figure 25:
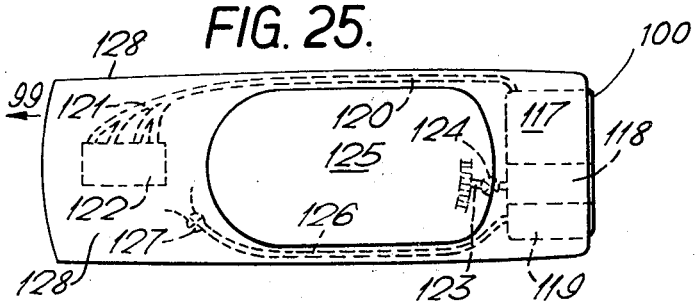
FIG. 25 shows a further embodiment of a chamber divided to process separate gas flows and its fitment by way of example to a family saloon car.
Figure 26:
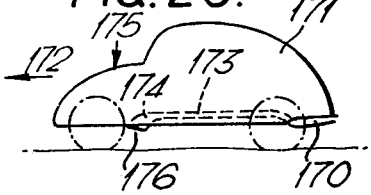
FIG. 26 shows diagrammatically a particular application for processing a separate gas flow.
Figure 27:
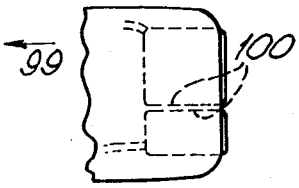
FIG. 27 shows alternative construction in the case of the embodiment of FIGS. 25 and 26.
Figure 28:
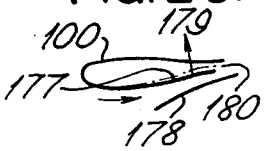
FIG. 28 shows an optional detail, relevant to some applications in the above.

FIG. 25 shows diagrammatically in plan view a vehicle having a silencer/extractor assembly fulfilling functions additional to or other than the treatment of exhaust gases. The chamber 100 is divided in the embodiment shown into three volumes, each separately communicating with the narrow discharge aperture running across the rear of the assembly and each volume having its own gas entry means. One volume 117 is connected via exhaust pipe 120 and manifold 121 to the engine 122, another volume 118 is connected via passage 123 and optional valve 124 to the passenger compartment 125 to act as ventilation means, the third volume 119 is connected via passage 126 and optional valve 127 to the engine compartment volume 128 to act as a possible extractor of cooling air. FIG. 26 shows how the silencer/extractor assembly 170 may be adapted to provide improved roadholding to a vehicle 171 normally travelling in direction 172 where the assembly is connected via passage 173 to an opening or scoop 174 in the central or forward underside of the vehicle. In operation, the extractor will provide a partial vacuum effect via the passage in the area 176 about the opening or scoop when the vehicle is in proper motion. This increased partial vacuum at 176 will result in increased downward pressure 175 about this point, and thus improving roadholding. It is well known that many vehicles suffer from high speed wander or front-end lightness due partially to a build up of air (and consequently pressure) underneath the central or forward portion of the vehicle, the dangers of which the invention would help offset. The silencer/extractor assembly may alternatively consist of a series of related chambers, each processing a gas flow from a different source, as shown in FIG. 27. Certain gas flows, e.g., those associated with the passenger compartment, may be desired to have a relatively constant flow rate and not be increased proportionately with vehicle speed, as would naturally be the case. In that case, the chamber 100 of FIG. 28 dealing with such gas flow may have a flexible and/or deformable surface 177 in association with an aerofoil 178. With increase in speed, the pressure build up between chamber aerofoil will cause the surface to be deformed in the direction 179, causing the slit aperture 180 to decrease in size and so provide increased resistance to the otherwise more powerful extraction effect.

FIG. 29 shows a silencer/extractor chamber 100 with exhaust inlet pipe 130, whose main discharge aperture is closable, and which has an (optional) alternative exhaust discharge means, here by example a stub tail pipe 131 with optional spring loaded valve 132. Such an arrangement could be incorporated in cross-country, amphibious or military vehicles. When such vehicles need to pass through water then the long aperture is closed (to prevent water entry past the relatively low discharge velocities) and the gas discharged either against a spring loaded or manual closure of the long aperture as described previously in connection with FIG. 5., or described above through the pipe 131 and optional valve 132, which may be pressure actuated. The tail pipe may be directed towards the upper part of the vehicle; such an arrangement would be suitable for amphibious vehicles and also for service vehicles operating in heavy snow conditions. The arrangement illustrated in FIG. 29 may also be used in vehicles having rear openings, such as estate cars or light delivery vans, etc., in order to meet legal and safety requirements. When a load is carried which necessitates the rear door remaining at least partly open, then the slit like exhaust gas aperture 129 is automatically shut, e.g., by linkages, and the gases directed through the tail-pipe 131. This will eliminate the risk of gases seeping from the chamber's long aperture, probably sited at the rear underside of the vehicle beneath the rear opening, into the interior space of the vehicle.

Figure 30:
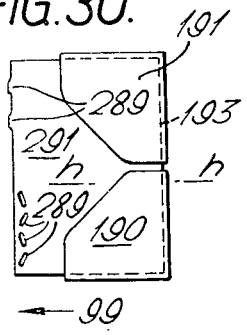
FIGS. 30 to 34 show means of overcoming any problems of ground clearance associated with the fitment of aerofoil members to the underside of chamber and/or vehicle.
Figure 31:
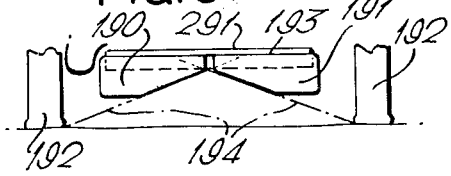
Figure 32:
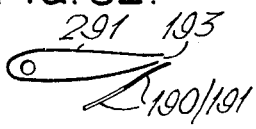
Figure 33:
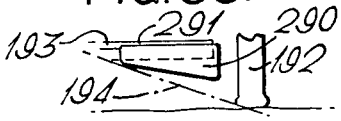
Figure 34:
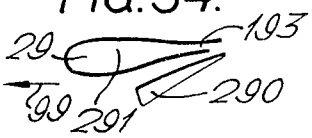

The aerofoils need not be of regular shape, nor need their length match that of the aperture to which they relate. The aerofoil may only cover part of the aperture length, or it may be 'covered' by two or more aerofoils placed side by side (i.e., not aero-dynamically one behind the other as in FIG. 11). In such a case they may further be of differing sizes or pitch, if it is desired that various portions of the discharge aperture are affected to differing degree by aerofoil action. FIG. 30 shows an underneath plan view of a silencer/extractor assembly having by way of example two adjacent aerofoils, 190 and 191. If aerofoils are used in association with the chamber 291, (having by way of example alternative aperture defining means 289 for the admission of air-flow within the chamber 291,) and the latter is mounted on the rear underside of vehicles, in the manner shown in FIG. 13, then is some cases the aerofoil if regular in shape may not be conveniently clear of the ground. The aerofoil(s) may therefore be progressively reducing in cross-sectional length towards the centre of the vehicle, as shown in plan FIG. 30, in rear elevational view in FIG. 31, where 192 are the rear wheels, 191 and 190 the aerofoils, 193 the slit-like discharge aperture and 194 the notional ground clearance lines. The same assembly is shown in cross-section through line *h* in FIG. 32. Alternatively the aerofoil 290 may be of regular shape but progressively varying pitch, as illustrated diagrammatically in rear elevation FIG. 33 and cross-section FIG. 34.

Figure 45:
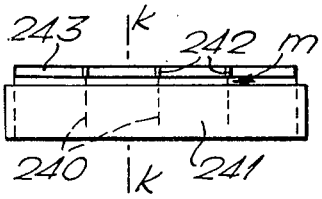
Figure 46:
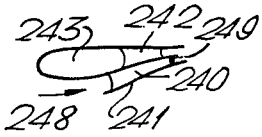
Figure 47:
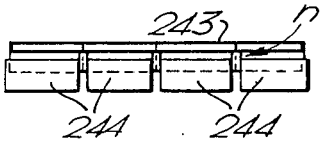
Figure 48:
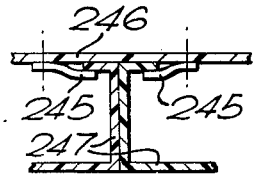
Figure 49:
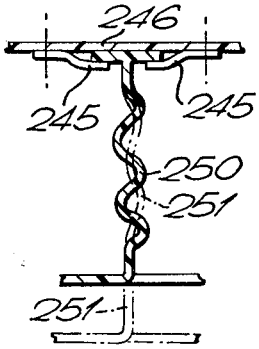
Figure 50:
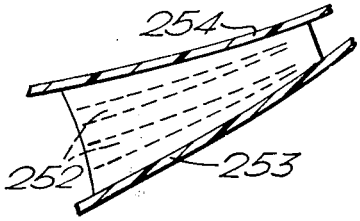
Figure 51:
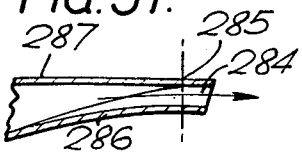
Figure 52:
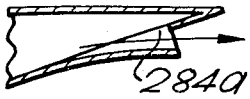
Figure 53:
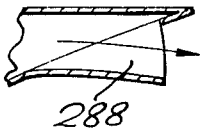

The aerofoils have so far been indicated spanning their full width between supports. However, it may be desirable to have intermediate supports, especially if the aerofoil is intended to transfer downward thrust and provide increased road holding. In such case, loads should preferably be properly transferred to the vehicle and not dissipated in any possible flexing of aerofoil or mountings. FIG. 45 shows such an arrangement in diagrammatic rear elevation, where the intermediate supports 240 of the aerofoil 241 coincide with optional stiffening and/or air-flow directing vanes 242 of the chamber 243, with FIG. 46 showing a cross-section along line *k*. FIG. 47 shows a succession of separate similar aerofoils 244 in line under chamber 243, with their supports optionally coinciding with stiffeners to the chamber. FIG. 48 shows in detail a possible fixing at *m* or *n* (FIGS. 45 and 47 respectively) where continuous or sequenced retaining clips 245 are fixed to the underside of the chamber 246 and the multiple or single aerofoil(s) and supports 247 are slid into position from direction 248 against a stop 249 (FIG. 46). An advantage of multiple aerofoil design is that they can be made of lighter section or weaker material, such as plastic rather than metal and a particular section need only be replaced when damaged. Damage will only affect one section and not radically the performance of the assembly as a whole. Where the aerofoil is designed to be of progressively varying pitch it may be constructed, e.g., of plastic, with flexible concertina shaped supports 250 as shown in FIG. 49. Under load these will deform to position 251. Such supports 250 may be of stronger concertina configuration at one end than the other, as can be seen in FIG. 50, a diagrammatic elevational cross-section through aerofoil 253 and underside of chamber 254, showing the concertina folded support 252. So far the aerofoil has been considered as a means of accelerating the air-flow along and past the discharge end of the chamber. However, an aerofoil member may also be used to control the air-flow past the aperture, by reducing the turbulence which may be caused by the placement of at least part of the chamber in the airflow past a vehicle. A known technique used in such control is shown in FIG. 37, where aerofoil members 292 are placed near the leading edge of the chamber, at a point where turbulence might originate.

Figure 41:
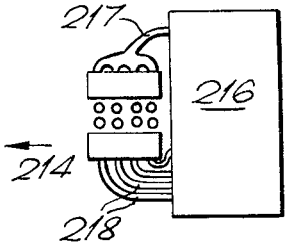
FIGS. 41 to 43 show in plan view alternative arrangements of the embodiment shown in FIG. 40.
Figure 42:
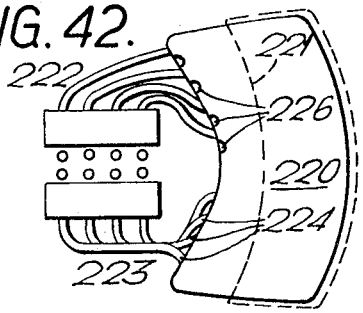
Figure 43:
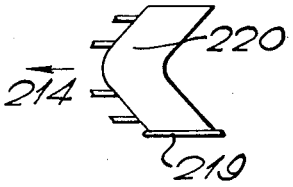
Figure 44:
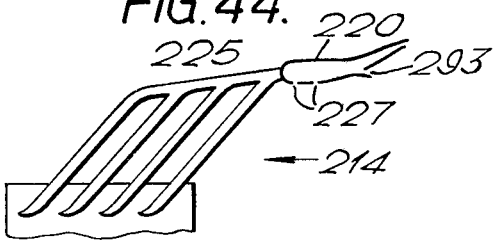
FIG. 44 shows in part side elevation the arrangement of FIG. 42.

An embodiment of the principles of the invention as applied to a specialist racing vehicle is shown in FIGS. 40 to 44. Here the gases are directed to an extractor/-silencer chamber 210 with optional associated aerofoils 211 mounted above the vehicle proper 212, so as to be fully exposed to relatively undisturbed airflow 213 when the vehicle is travelling in direction 214, and to allow driver rear vision in the space between the assembly (which may be supported on struts) and the vehicle proper. Optionally, the whole extractor/silencer assembly may be mounted so as to act not only as a gas extractor but also as a general aerofoil to improve road adhesion. This may be achieved by tilting the chamber and aerofoils so as to tend to deflect air upwards, thereby causing a downward load 215 to be transmitted to the assembly and, by means of its fixings to the vehicle. FIG. 41 shows in diagrammatic plan view by way of example the assembly 216 of rectangular proportions fitted above a V-8 engine. Each bank may have a single collected exhaust pipe 217 or separate multiple pipes 218 connected and discharging into the assembly 216. The assembly may also be of V or boomerang shaped configuration as shown in diagrammatic plan view in FIG. 43, where direction of travel is 214 and any aerofoil loads would tend to be greatest toward the extremities, where a fin 219 may be provided to prevent air spillage sideways off the edge. FIG. 42 shows in similar plan view an assembly 220 including an aerofoil shown dotted at 221 normally travelling in direction 214 where any aerofoil loads would tend to be greatest towards the centre, a possibly safer arrangement for racing vehicles than that shown in FIG. 43. Since any variation in load affects the most stable part of the vehicle, rather than an extremity with consequent danger of tipping over or losing part adhesion on cornering. FIG. 42 shows alternative (exhaust) pipe arrangements where at 222 each pipe of the engine bank makes a flowing path to the assembly and is to a considerable degree exposed to the air stream, while at 223 the pipes in their rise from engine to the assembly are aligned one behind the other to distribute to separate entry points as at 224 or alternatively gather at the top just before a collected entry to the chamber 220 as at 225 in the diagrammatic elevational section of FIG. 44. Optionally, the air-flow entry means about the leading edge, described earlier, may be incorporated in racing car applications, as for example holes 226 spaced between exhaust gas entry point in FIG. 42. If the exhaust pipes are aligned one behind the other, the pipes may be of progressively varying diameter, in proportion to volume of exhaust gas flow which is in turn affected by temperature, i.e., the leading coolest pipe is narrower than the trailing hottest pipe.

The provision of what is in effect a hollow aerofoil (admitting the passage of air) mounted above the vehicle offers the opportunity to introduce a further vehicle safety means. It is known in racing circles that aerofoils whilst normally providing desired downthrust and increased stability, may in freak conditions when subjected to gusts be dangerous, in that the aerofoil may be partly lifted from underneath by turbulence, freak winds, etc., and cause an unexpected reduction of adhesion for which the driver is often not prepared. The provision of carefully positioned apertures 227 or reverse scoops 293 in the central or forward underside of the chamber 220 will act as a safety means in such conditions, in that the updraught of air from such turbulence will not be wholly directed onto the underside of the chamber and so cause upthrust, but will greatly be dissipated through the holes into the internal volume of the chamber there to effect the gas pressures and rates of gas flow, but not to cause a significant upthrust on any surface. In a racing vehicle intended to travel between 100 and 200 miles per hour, the gas and air velocities will be so great that such holes, carefully positioned where the pressures inside and outside the chamber are about equal, will not materially affect the extraction principles about the discharge aperture.

The material details of manufacturing methods used in the construction of the invention are intended to be those generally in use in the industry, and described by example in FIGS. 1 to 4. Such portions of the assembly as are exposed to exhaust gas would conventionally be made of metal, preferably stainless steel, but, with recent advances in materials technology, they could also be made from a corrosion resistant, high temperature plastic or composite material. Aerofoils and chambers or parts of chambers not in contact with exhaust gases could be made of metal, preferably either ferrous or non-ferrous metals, but more readily out of plastic or composites, especially in the case of the (passenger compartment) air extractor having a deformable surface.

The various features of the foregoing disclosure may be used in any combination with each other and in any suitable embodiment of the invention. It is felt that the disclosure constitutes a proper description of the manner in which the invention can be realistically embodied and adapted to the motor industry of today, and so contribute to the solution of some of the major problems now facing the industry.

I claim:

1. In combination with a surface vehicle, at least one chamber mounted to said vehicle such that said chamber is disposed in the air-flow past said vehicle when said vehicle is in motion, said chamber having an exhaust gas inlet and an exhaust gas outlet, the flow of exhaust gases between said inlet and outlet being substantially unidirectional and parallel to the air-flow past said vehicle, said discharge outlet comprising an elongated aperture arranged to discharge the flow of exhaust gases from said chamber in a direction substantially parallel to the direction of air-flow past said vehicle and at least one aerofoil member mounted externally of said chamber in the air-flow past said vehicle, said aerofoil member being oriented relative to said elongated aperture to effect an increase in air-flow velocity past said aperture during forward motion of said vehicle.

2. The combination according to claim 1 wherein said chamber has a substantially U-shaped cross-section, said elongated aperture being formed by the open end of the U-shaped cross-section.

3. The combination according to claim 1 wherein said chamber is mounted to the underside of said vehicle.

4. The combination according to claim 1 wherein said chamber is mounted above said vehicle.

5. The combination according to claim 1, including means for mounting said aerofoil member such that the orientation of at least a portion of said aerofoil member relative to said chamber progressively changes with increasing velocity of said vehicle.

6. The combination according to claim 1, wherein at least a portion of said chamber adjacent said elongated aperture is deformable such that the size of said aperture progressively changes with increasing velocity of said vehicle.

7. The combination according to claim 1, wherein said vehicle includes a compartment and wherein said chamber is divided into a plurality of separate volumes, one of said plurality of separate volumes communicating with said compartment via a conduit, said compartment being ventilated through said conduit and said one volume.

8. The combination according to claim 7 wherein said compartment comprises a passenger compartment and including valve means in said conduit for shutting off the communication between said one volume and said passenger compartment.

9. The combination according to claim 8 including an engine compartment communicating with a second one of said plurality of separate volumes via a second conduit and second valve means in said second conduit for shutting off the communication between said second volume and said engine compartment.

10. The combination according to claim 1, including means for progressively closing said elongated aperture.

11. The combination according to claim 10 including an alternative exhaust gas discharge outlet connected to said chamber and valve means in said alternative discharge outlet.

12. The combination according to claim 1 wherein said chamber is positioned in the air-flow past said vehicle so as to cause a downthrust on said chamber and including means connecting said chamber to said vehicle for transmitting the downthrust to said vehicle.

13. The combination according to claim 1 wherein said aerofoil member is positioned in the air-flow past said vehicle so as to cause a downthrust on said aerofoil member and including means connecting said aerofoil member to said vehicle for transmitting the downthrust to said vehicle.

14. The combination according to claim 1 including means connecting at least a portion of said chamber with a space beneath said vehicle for reducing the air pressure in the space to thereby improve the road adhesion of said vehicle.

15. The combination according to claim 1 wherein said elongated aperture has upper and lower lips, said upper lip projecting beyond said lower lip in a rearwardly direction relative to the normal forward direction of motion of said vehicle.

16. The combination according to claim 15 wherein a portion of said aerofoil member projects beyond said lower lip in a rearwardly direction relative to the normal forward direction of motion of said vehicle.

17. The combination according to claim 15 wherein said chamber has a substantially U-shaped cross-section, said upper and lower lips forming the open end of the U-shaped cross-section, said upper and lower lips and said aerofoil member being disposed in converging relation to each other.

* * * * *